United States Patent [19]

Hammond

[11] Patent Number: 5,014,869

[45] Date of Patent: May 14, 1991

[54] SANITARY CAN SEAL ORGANIZATION

[76] Inventor: David W. Hammond, 4171 Marquis Way, Salt Lake City, Utah 84124

[21] Appl. No.: 500,526

[22] Filed: Mar. 26, 1990

[51] Int. Cl.[5] ..... A47G 19/22; B65D 51/20

[52] U.S. Cl. ..... 220/90.2; 206/205; 215/249; 215/251; 220/87.1; 220/257

[58] Field of Search ..... 206/205; 215/251, 254, 215/255, 227, 228, 246, 247, 249; 220/90.2, 85 R, 87, 256–258

[56] References Cited

U.S. PATENT DOCUMENTS

| | | | |
|---|---|---|---|
| 1,189,465 | 7/1916 | Mayo | 215/247 |
| 1,431,871 | 10/1922 | Burnet | 215/247 |
| 1,932,617 | 10/1933 | Ford et al. | 215/246 X |
| 2,731,999 | 1/1956 | Burns | 220/258 X |
| 3,029,973 | 4/1962 | Burchett | 220/90.2 X |
| 3,046,711 | 7/1972 | Harrison | 206/158 X |
| 3,085,683 | 4/1963 | Harrison | 206/158 X |
| 3,095,103 | 6/1963 | Harrison | 215/246 |
| 3,204,805 | 9/1965 | May | 220/90.2 X |
| 3,338,445 | 8/1967 | Lange | 215/254 |
| 3,763,998 | 10/1973 | Fisher | 206/229 X |
| 4,328,905 | 5/1982 | Hardt | 220/258 |
| 4,483,450 | 11/1984 | Sanchez | 215/254 |
| 4,651,890 | 3/1987 | Coker et al. | 220/85 R |
| 4,815,628 | 3/1989 | Wehnert, III | 220/258 X |

FOREIGN PATENT DOCUMENTS

| | | | |
|---|---|---|---|
| 1236241 | 3/1967 | Fed. Rep. of Germany | 206/205 |
| 2825254 | 12/1979 | Fed. Rep. of Germany | 220/258 |

*Primary Examiner*—Bryon P. Gehman
*Attorney, Agent, or Firm*—Leon Gilden

[57] ABSTRACT

A can sealing organization including an elongate central web with a downwardly depending skirt formed about a matrix of cylindrical beverage containers. The beverage containers each include an individual cap member heat sealed in a surrounding relationship to each upper end of each can, wherein each cap is integrally formed to the central web. Additionally, each cap member includes an antiseptically saturated sponge member mounted between an upper surface of the can and the cap captured therebetween, wherein each sponge member may further be formed of a doughnut-like configuration defining a central cylindrical opening containing a rupturable anti-bacterial fluid contained therewithin.

3 Claims, 4 Drawing Sheets

PRIOR ART

SANITARY CAN SEAL ORGANIZATION

BACKGROUND OF THE INVENTION

1. Field of the Invention

The field of invention relates to can securement organizations, and more particularly pertains to a new and improved sanitary can sealing organization wherein the same securely and sanitarily isolates an upper surface of each can during transport and storage thereof prior to use.

2. Description of the Prior Art

Various securement means have been set forth in the prior art to secure individual cans during their transport and storage prior to their use. contemporary communicable disease and its spread requires that precautions be taken prior to consumption of a beverage from a commercially distributed beverage container to prevent inadvertent spread of such disease. Prior art examples of sealing organizations includes U.S. Pat. No. 3,516,537 to Dreyfus, et al. setting forth a bag-like member of containing a food component therewithin in a surrounding sealing relationship.

U.S. Pat. No. 3,473,703 to Lippincott sets forth a unitary fluid dispensing package wherein the package includes a tear strip to gain access to contents within the package.

U.S. Design Pat. Nos. 289,973; 294,801; and 285,412 are further examples of sealing arrangements to contain various merchandise in a sealed relationship.

As such, it may be appreciated that there continues to be a need for a new and improved sanitary can sealing organization wherein the same addresses the problems of ease of use and access to cans contained by the organization, as well as sanitarily isolating and sealing the top surface of the can arranged for oral communication with individuals during consumption of contents from the can, and as such the present invention substantially fulfills this need.

SUMMARY OF THE INVENTION

In view of the foregoing disadvantages inherent in the known types of can sealing apparatus now present in the prior art, the present invention provides a sanitary can sealing organization wherein the same sealingly and sanitarily isolates the top drinking surface of individual beverage containers. As such, the general purpose of the present invention, which will be described subsequently in greater detail, is to provide a new and improved sanitary can sealing organization which has all the advantages of the prior art can sealing apparatus and none of the disadvantages.

To attain this, the present invention provides a can sealing organization including an elongate central web with a downwardly depending skirt formed about a matrix of cylindrical beverage containers. The beverage container each include an individual cap member heat sealed in a surrounding relationship to each upper end of each can, wherein each cap is integrally formed to the central web. Additionally, each cap member includes an antiseptically saturated sponge member mounted between an upper surface of the can and the cap captured therebetween, wherein each sponge member may further be formed of a doughnut-like configuration defining a central cylindrical opening containing a rupturable anti-bacterial fluid contained therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved sanitary can sealing organization which has all the advantages of the prior art can sealing apparatus and none of the disadvantages.

It is another object of the present invention to provided a new and improved sanitary can sealing organization which may be easily and efficiently manufactured and marketed.

It is a further object of the present invention to provide a new and improved sanitary can sealing organization which is of a durable and reliable construction.

An even further object of the present invention is to provide a new and improved sanitary can sealing organization which is susceptible of a low cost of manufacture with regard to both materials and labor, and which accordingly is then susceptible of low prices of sale to the consuming public, thereby making such sanitary can sealing organizations economically available to the buying public.

Still yet another object of the present invention is to provide a new and improved sanitary can sealing organization which provides in the apparatuses and methods of the prior art some of the advantages thereof, while simultaneously overcoming some of the disadvantages normally associated therewith.

Still another object of the present invention is to provide a new and improved sanitary can sealing organization wherein the same completely secures and seals in an encircling and encompassing relationship a top drinking surface of a can prior to use preventing inadvertent transmission of communicable diseases.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrative preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
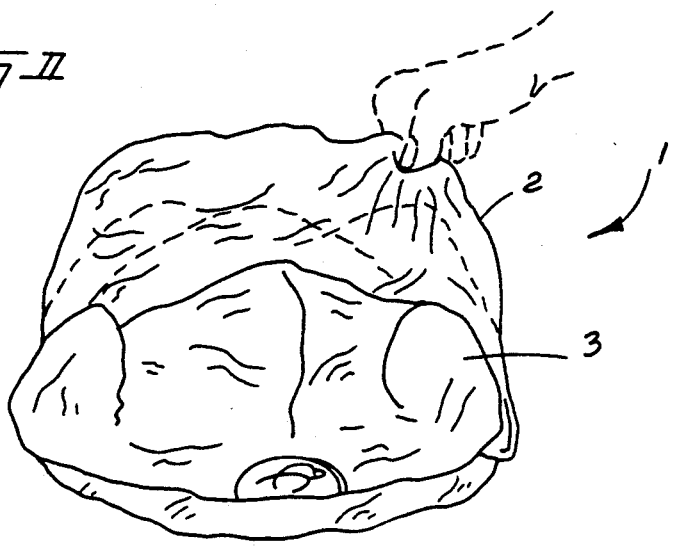
FIG. 1 is an isometric illustration of a prior art sealing organization.

With reference now to drawings, and in particular to FIGS. 1 to 9 thereof, a new and improved sanitary can sealing organization embodying the principles and concepts of the present invention and generally designated by the reference numeral 10 will be described.

Figure 2:
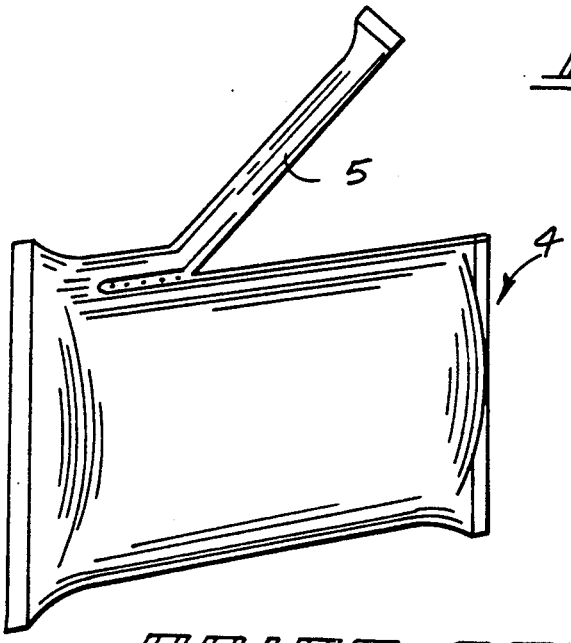
PRIOR ART Fig 2
FIG. 2 is an isometric illustration of a further prior art sealing package.
Figure 3:
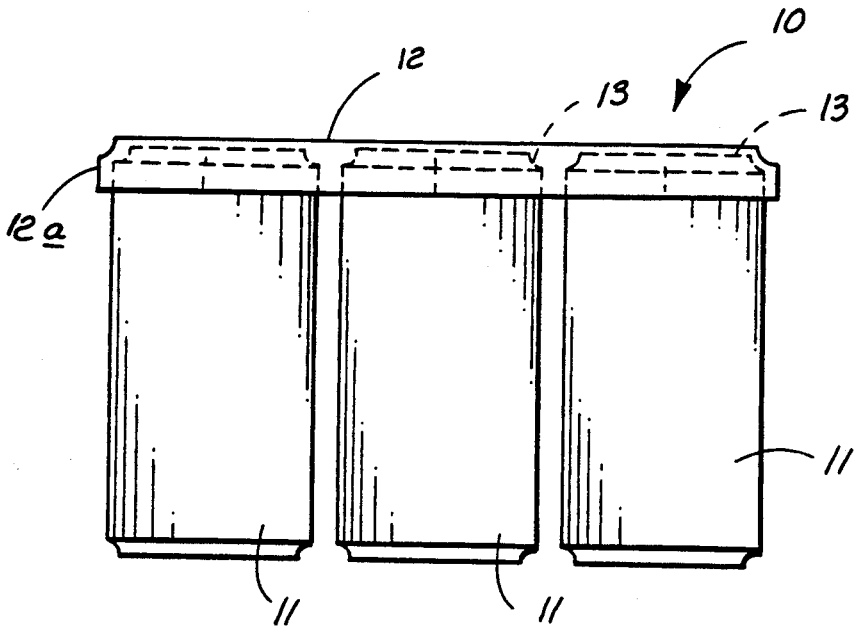
FIG. 3 is an orthographic side view, taken in elevation, of the instant invention.
Figure 4:
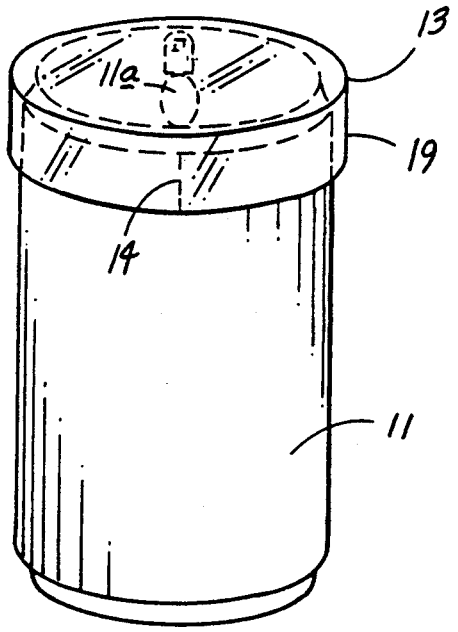
FIG. 4 is an isometric illustration of an individual can sealing cap utilized by the instant invention.
Figure 5:
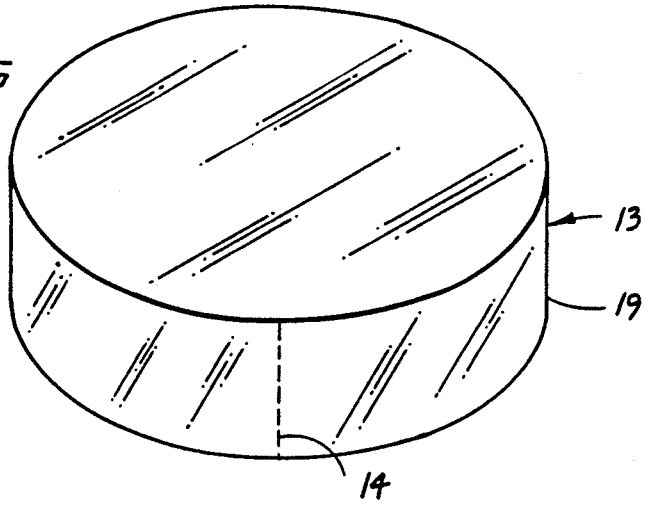
FIG. 5 is an isometric illustration of the sealing cap of the instant invention.

FIG. 1 is an illustration of a prior art sealing bag 1 wherein an encompassing bag 2 sealingly contains a food component 3 therewithin in a surrounding sealing relationship to prevent inadvertent and undesirable transmission of various contaminants in contact with the food component 3. FIG. 2 illustrates a further prior art sealing bag 4 utilizing a removable tear strip 5 to gain access to components contained within the bag to typically maintain such components in a surrounding relationship to prevent contact of those components with undesirable contaminants.

More specifically, the sanitary can sealing organization 10 of the instant invention essentially comprises the device in combination with a matrix of cylindrical beverage containers 11 that each include an upper top end cap containing an access opening 11*a* formed therewithin, usually of a quickly removable tab type structure. An elongate planar transparent web 12 is formed coextensively overlying the top surfaces of the beverage containers 11 with a downwardly depending web skirt 12*a* directed downwardly from the elongate web 12. Individual transparent cup-shaped cap members 13 are formed in a surrounding heat shrunk relationship overlying the top surface of each of the cans 11 and the upper cap end members containing such access openings 11*a*. The cup-shaped cap member 13 includes a downwardly depending cap member skirt 19, wherein each of the skirts is of a generally annular configuration, with a tear strip 14 formed through each of the skirts, wherein each tear strip is arranged generally parallel to the axis of each skirt 19. The cap members 13, as noted above, are provided for use with individual cans 11, or with a matrix of cans for use with the elongate web 12, wherein use with the elongate web 12, each planar top surface of each cap member 13 is integrally formed to the web 12 to securely and fixedly mount each of the cap members thereto. In this manner, each top surface of each can is sealingly isolated from exposure to a surrounding environment preventing contamination of the top surface that directs fluid from within each can 11 through the access opening 11*a*.

Figure 6:
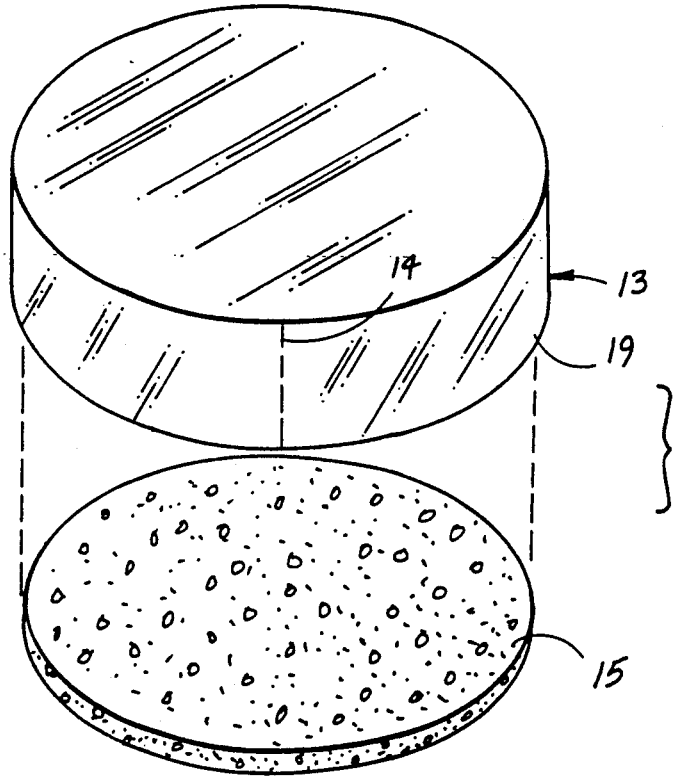
FIG. 6 is an isometric illustration, somewhat exploded, of the intant invention utilizing a disinfectant liner.
Figure 7:
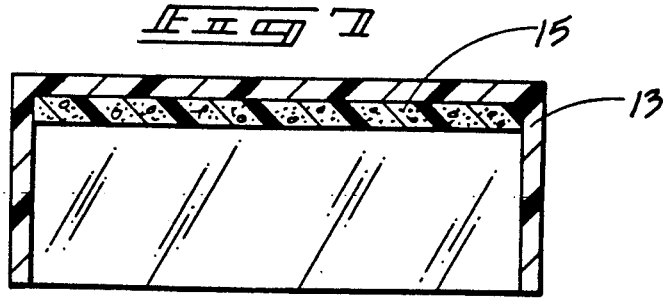
FIG. 7 is a cross-sectional orthographic view of the can sealing cap of FIG. 5.

Reference to FIGS. 6 and 7 note the use of each cap member 13 formed with a cylindrical sponge 15 formed to an interior surface of each cap contained interiorly of each skirt 19 fixedly mounted adjacent an interior surface of each top surface of each cap member. Each cylindrical sponge 15 is typically saturated with an antiseptic fluid to ensure a sanitary top surface of each can as each sponge member in use in mounted in contiguous and coextensive overlying relationship to each top surface of each can. Accordingly, each sponge 15 is defined by an external diameter substantially equal to an internal diameter of each skirt member 19.

Figure 8B:
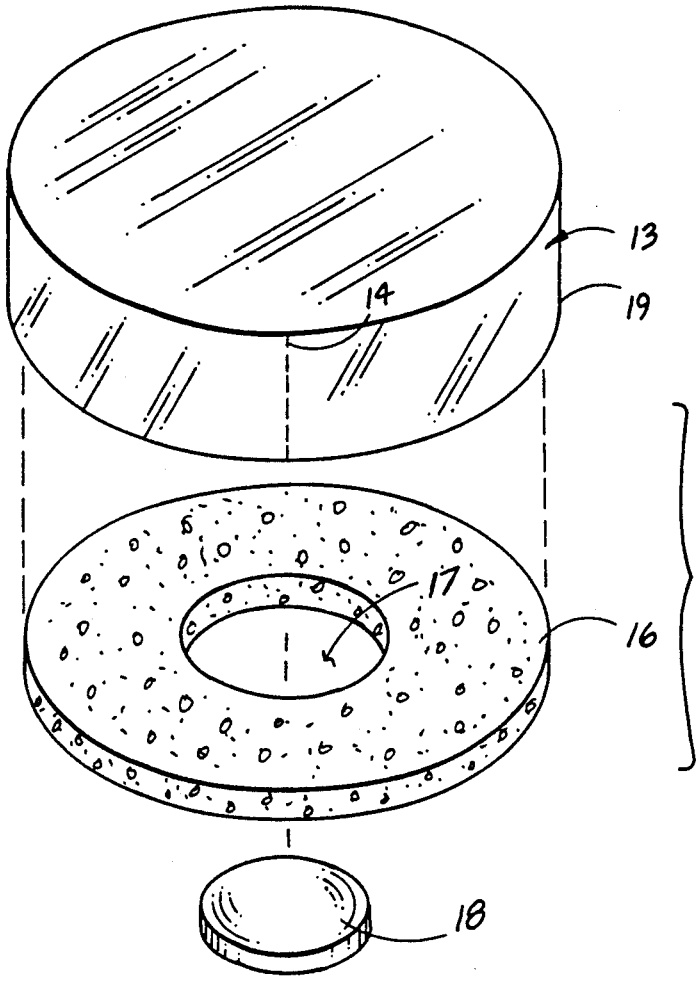
FIG. 8 is an exploded isometric illustration of a further example of a can disinfecting liner utilized by the instant invention.
Figure 9:
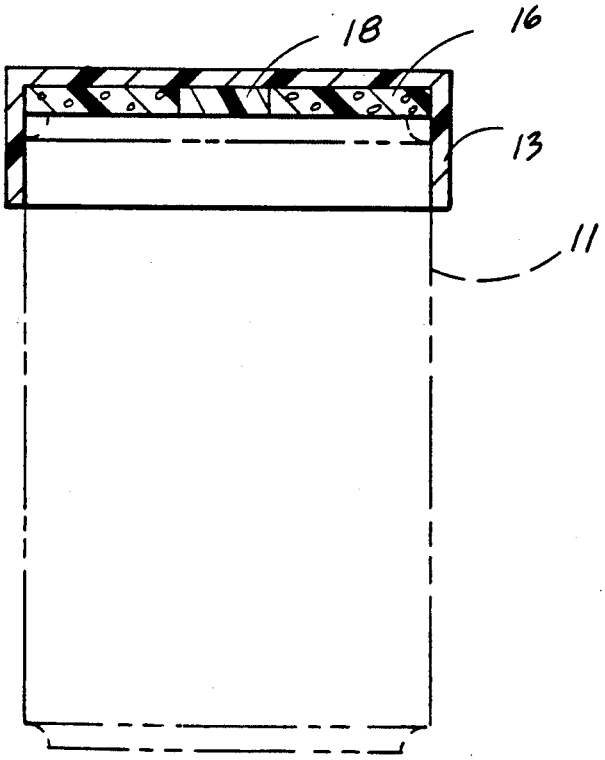
FIG. 9 is a cross-sectional orthographic view of the can sealing liner of FIG. 8.

FIG. 8 illustrates the use of the instant invention of a generally doughnut shaped sponge 16 integrally mounted to an interior surface of each top surface of each skirt, wherein each doughnut shaped sponge is also provided with an antiseptic fluid contained therewithin and also defined by an external diameter substantially equal to an internal diameter of each skirt 19. Each doughnut shaped sponge 16 is defined by a coaxially aligned cylindrical opening 17. Each cylindrical opening 17 includes a rupturalble capsule 18 containing a fluid disinfectant therewithin, whereupon an individual to ensure dispensation of such a disinfectant to a top surface of each can 11 may accordingly rupture an individual capsule 18 and direct such fluid about the top surface of each can about the access opening 11*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A sanitary can seal organization comprising, in combination, an elongate cylindrical beverage container, the beverage container including a consumable food component therewithin, the beverage container including a top lid, wherein the top lid defines a continuous surface coaxially arranged relative to the beverage container, further including a cup-shaped cap member mounted overlying the lid, wherein the cup-shaped cap member includes a top web, and the top web is of a generally annular configuration and includes a cylindrical downwardly depending skirt, the downwardly depending skirt is formed in a heat sealed relationship overlying the top lid of the cylindrical beverage container, the skirt includes a perforated tear strip directed through the skirt, and wherein the tear strip is arranged parallel to an access defined by the skirt, the cup-shaped cap member is transparent, the annular skirt is directed below the lid of the container surroundingly engaging the container, and further including a cylindrical sponge, the cylindrical sponge including a germicidal fluid contained therewithin, and the cylindrical sponge mounted in contiguous and coextensive relationship to an interior surface of the top web interiorly of the skirt, and the sponge defined by an external diameter substantially equal to an internal diameter defined by the skirt.

2. An organization as set forth in claim 1 wherein the sponge includes a central cylindrical opening, the cylindrical opening arranged coaxially of the sponge, and the cylindrical opening containing a rupturable capsule contained therewithin, the rupturable capsule including a germicidal fluid contained therewithin, and the sponge and the capsule arranged in contact with the lid of the cylindrical container.

3. An organization as set forth in claim 2 including a plurality of cap members, and each cap member is fixedly mounted in a geometric matrix to a bottom surface of a continuous web, and the continuous web including a downwardly directed perimeter skirt, and each cap member including a cylindrical container mounted therewithin in a heat sealed relationship.

* * * * *